United States Patent [19]

Moody

[11] Patent Number: 5,017,150

[45] Date of Patent: May 21, 1991

[54] LOW FORCE CABLE DISCONNECT

[75] Inventor: Paul E. Moody, Barrington, R.I.

[73] Assignee: The United States of America as represented by the Secretary of the Navy, Washington, D.C.

[21] Appl. No.: 527,978

[22] Filed: May 24, 1990

[51] Int. Cl.[5] ..... H01R 13/523

[52] U.S. Cl. ..... 439/197; 439/199

[58] Field of Search ..... 439/190, 197, 198, 199, 439/201, 205, 206, 204

[56] References Cited

U.S. PATENT DOCUMENTS 3,508,188 4/1970 Buck ..... 439/199

3,845,450 10/1974 Cole et al. ..... 439/190

FOREIGN PATENT DOCUMENTS 2576718 8/1986 France ..... 439/199

274176 6/1970 U.S.S.R. ..... 439/199

*Primary Examiner*—Gary F. Paumen

*Assistant Examiner*—Kevin I. Carroll

[57] ABSTRACT

An underwater receptacle has a pressure balancing arrangement that balances the underwater force that tend to hold a receptacle and its mated plug together. The pressure balancing arrangement also relieves the air pressure formed between the insert discs of the plug and receptacle when connecting the insert discs respective electrical pins and sockets. This is achieved by moving the volume of air formed between the discs on connecting the respective components. The volume of air passes through the receptacle disc and operates a piston to form a chamber for holding the volume of air. The other side of the piston is exposed to sea pressure. This forces the volume of air back into its original position and eliminates a vacuum suction by neutralizing the pressure on the plug when disconnecting the plug from the receptacle.

5 Claims, 1 Drawing Sheet

LOW FORCE CABLE DISCONNECT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an electrical connector. More particularly the connector is designed for ease of separation from a mating connector in a high pressure environment. The present invention has specific use on a receptacle affixed to a torpedo when it is necessary to disconnect the attached cable connection underwater.

(2) Description of the Prior Art

The existing underwater cable connection to a submarine launched torpedo has had reliability problems due to its design. To a great extent this is due to either the short circuiting or non-contact between the cable and the weapon's cable receptacle. In the prior art the cable used a plug to fit in the receptacle's socket. The difficulty with a common plug/socket connection is that sea pressure tends to hold the connection together and the greater the depth, the greater the exterior holding force. This force can be overcome by the use of a lanyard, as the weapon launcher system has more than adequate force to overcome the force on the cable end tending to hold the cable end plug together with the weapon's socket receptacle. Identifying a location to anchor a lanyard is a design problem that causes difficulty with a swimout launch due to the force that holds the connection together. The problem is that a swimout launch slowly accelerates and at the start of this acceleration it has a relatively small forward thrust. This relatively small thrust that is used to move the weapon is ineffective to adequately separate the cable connection. Prior to the separation various problems such as the weapon being held in place by the cable, the weapon propeller cavitating, overspeeding, and shutting down may be encountered.

SUMMARY OF THE INVENTION

Accordingly, it is a general purpose and object of the present invention to provide an improved electrical connector that is suitable for detachment from its mating component when the connector and its mating component are under increased external pressure. It is a further object to provide a connector suitable for use when the increased external pressure is provided by sea water. It is an additional object to nullify the increased holding force on the mated electrical connector and its mating connector by balancing the internal pressure within the electrical connector. Another object is to improve the initial mating of the connector and its mating component by preventing the increase of pressure between their faces on initial mating.

These objects are accomplished with the present invention by providing a connector receptacle assembly in which a subassembly holds not only the electrical pins but has a plurality of apertures in which legs are extended from a piston in back of the assembly. The piston forms a sliding hermetic seal barrier with the inner walls of the receptacle and the piston is compressed against a spring by the pressure formed on mating the receptacle connector with an insert from a cable. A filter that is permeable to sea pressure is located in back of the piston. A change in sea pressure will not move the piston as the force on the piston is counterbalanced by an equal and opposite force on the mating cable connector. This enables easier separation of the cable connector insert from the receptacle insert when there is a high pressure in the surrounding environment such as that caused by sea pressure deep under the water.

DESCRIPTION OF THE PREFERRED EMBODIMENT

Figure 1:
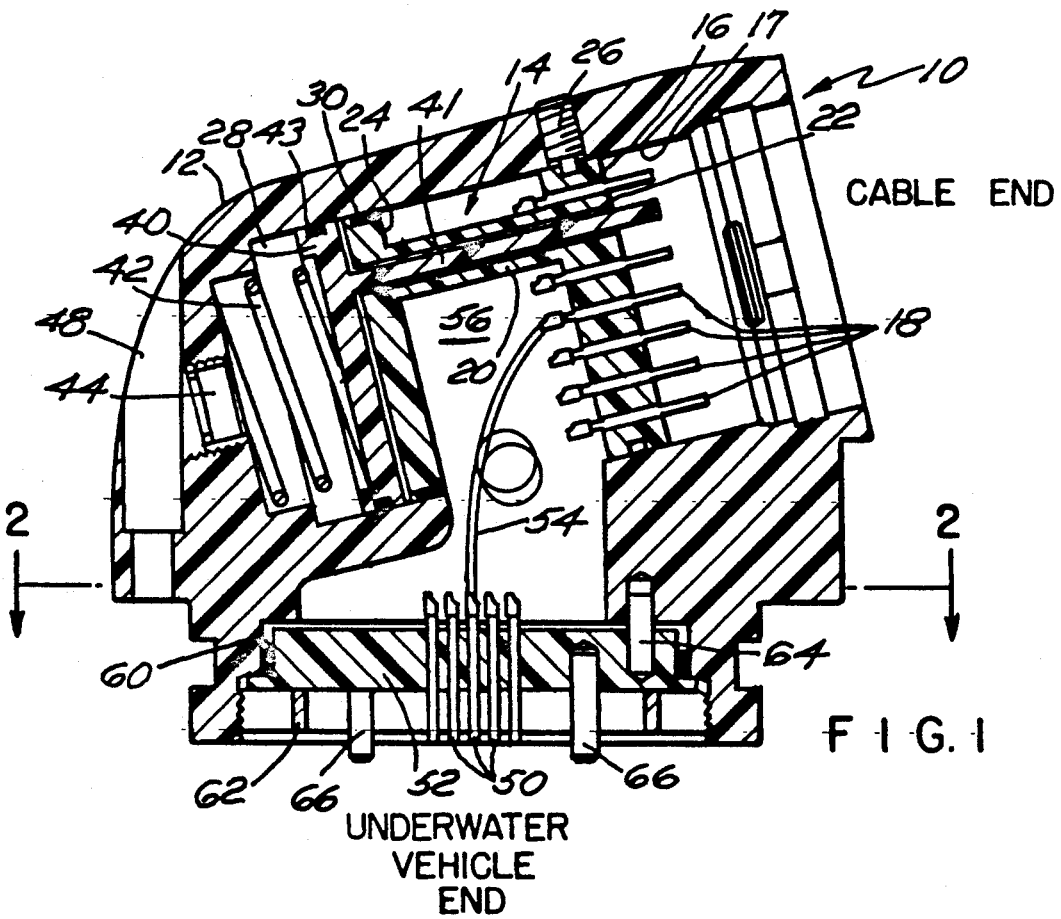
FIG. 1 is cross-sectional view of an underwater connector receptacle in accordance with the present invention.

Referring now to FIG. 1 there is shown an underwater connector receptacle 10 having a housing 12. The underwater connector receptacle 10 at one end connects to a cable end plug (not shown) and at the other end extends through the wall of an underwater vehicle (not shown).

The housing 12 encloses an end cap/hermetic insert subassembly 14. The end cap/hermetic seal insert subassembly 14 comprises an hermetic insert disc 16 that forms an hermetic seal with a cylindrically shaped inner wall portion 17 of the housing 12. The hermetic insert disc 16 holds a plurality of pins 18. In addition the subassembly 14 comprises three pipes 20 having apertures 22 that are spaced on the disc normally an equal distance from the axis of disc 16 but and at equal angles from each other around the disc 16. The three pipes 20 at the end opposite the disc 16 are connected to an end cap 24. Apertures 22 extend through the end cap 24 that also forms part of the sub-assembly 14. A locking screw 26 affixes the entire end cap/hermetic seal insert subassembly 14 to the housing 12 by holding the hermetic insert disc 16 in place. The end cap 24 is located at one end of piston chamber 28 of the housing 12. The end cap 24 has an O-ring seal 30.

A piston 40 is located in back of the blank disc 24 within the housing 12. The piston 40 rides on a sliding seal 43. The piston 40 has three legs 41 that extend through the apertures 22 of pipes 20. The piston 40 compresses a spring 42. The spring 42 provides positive positioning of the piston 40 at all times. A filter 44 is located in back of the spring 42 at the other end of the piston chamber 28 and is exposed to the surroundings outside of the housing 12. The filter 44 is permeable to the seawater and its pressure but keeps major contaminants out of the spring area.

The underwater connector receptacle 10 is affixed to the underwater vehicle by means of screws or bolts (not shown) through apertures 48. The electrical connections to the underwater vehicle from the underwater connector receptacle 10 are made through pins 50 located in a disc 52. All pins 18 in disc 16 are connected by wires 54 to respective pins 50 in disc 52. The wires 54 are located within an environmentally sealed interior chamber 56. In FIG. 1, for simplicity sake only one electrical wire 54 connecting a pin 18 to a respective pin 50 is shown. It is to be understood that many more wires 54 connecting respective pins 18 and 50 are utilized.

The remaining components are O-ring 60, retaining nut 62, alignment pin 64, and further alignment pins 66.

Figure 2:
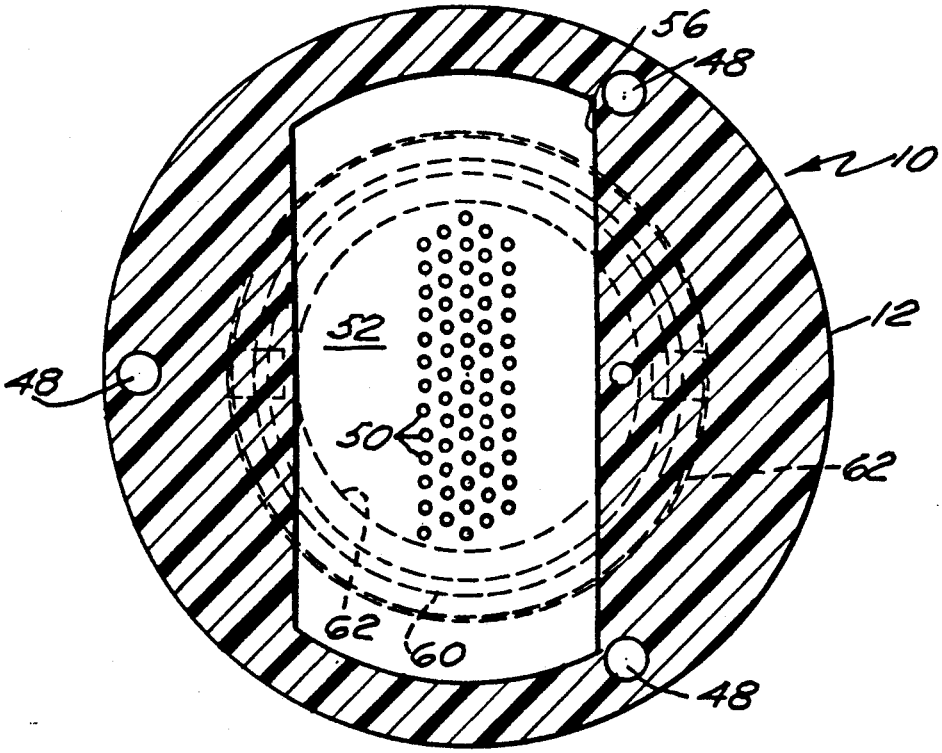
FIG. 2 is a view of the underwater connector receptacle along the line 2—2 of FIG. 1.

FIG. 2 shows a view along the line 2—2 of FIG. 1. It depicts the large number of pins 50 that are normally utilized in such an arrangement.

In operation, when the cable end plug is mated to the receptacle 10, the invention prevents the compression of air from being built up in the receptacle 10 as the pins is start to slide into the sockets of the cable's plug connector. Instead, when the cable connector is pushed onto the pins 18, it also simultaneously pushes on the legs 41 of the piston 40. The volume of air which is normally trapped between the hermetic insert disc 16 and the cable end plug is, therefore, displaced through the clearance between the piston legs 41 and pipes 20 to the area between the piston 40 and the stationary end cap 24. This movement of the piston 40 prevents the volume of air entrapped between the cable end plug and the hermetic insert disc 16 from being compressed during cable insertion of its sockets into the pins 18 of the hermetic insert disc 16.

On disconnecting the cable plug from the receptacle 10, the following takes place. As the cable sockets of the plug are pulled from the pins 18 of the receptacle's 10 hermetic insert disc 16 the entrapped volume of air remains unchanged. The increase in space between the cable plug's insert and the receptacle's insert 16 is offset by a decrease in the space between the receptacle's 10 piston 40 and the receptacle's 10 end cap 24. Therefore, there is no tendency to pull a vacuum between the cable plug's insert and the hermetic insert disc 24 of the receptacle 10.

The insert seal of the cable plug is located on the same diameter as the piston 40 of the receptacle. The pressure exerted on the piston 40 through the filter 44 results in a balance of forces resulting from the sea pressure which will be equal and in opposite directions, therefore, balancing one another out. This reduces the force necessary to separate the cable plug from the receptacle 10 underwater.

There has therefore been described an underwater receptacle that has the primary advantage that it will provide a means of making a low force connection/disconnection to a mating component in a pin and socket arrangement that is independent of sea pressure.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A low force cable disconnect comprising:

an end cap/hermetic seal insert sub-assembly having an end cap and hermetic seal insert with each of said end cap and hermetic seal insert having at least one aperture connected by at least one pipe, said hermetic seal insert having at least one electrical contact;

a housing comprising holding means for holding said end cap/hermetic seal insert sub-assembly, said holding means comprises a piston chamber holding said end cap;

a piston located within said piston chamber and arranged for sliding along the inner walls of said piston chamber, said piston located in alignment with said end cap for increasing and decreasing the volume within said piston chamber between said piston and said end cap;

a filter located at the end of said piston chamber and exposed to the outside of said housing, said filter being permeable to selected fluids and said filter being located for permitting said selected fluids to exert pressure upon said piston;

a connector disc separate from said hermetic seal insert within said housing, said connector disc having at least one electrical contact; and at least one electrical wire connecting said at least one electrical contact of said hermetic seal insert to said at least one electrical contact of said connector disk.

2. A low force cable disconnect according to claim 1 further comprising at least one leg connected to said piston and extending into said at least one pipe.

3. A low force cable disconnect according to claim 2 further comprising a spring located within said piston chamber between said filter and said piston.

4. A low force cable disconnect according to claim 3 further comprising an environmentally sealed interior chamber enclosing said at least one electrical wire.

5. A low force cable disconnect according to claim 4 wherein said housing further comprises three apertures.

* * * * *